United States Patent [19]

Hueniken et al.

[11] Patent Number: 5,010,217

[45] Date of Patent: Apr. 23, 1991

[54] INERTIA SWITCH MOUNTING HOUSING

[75] Inventors: Peter Hueniken, Chatham; John A. Gurd, Wallaceburg; Douglas Woodman, Chatham, all of Canada

[73] Assignee: Siemens Automotive Limited, Chatham, Canada

[21] Appl. No.: 485,342

[22] Filed: Feb. 26, 1990

[51] Int. Cl.[5] ..... H01H 35/14

[52] U.S. Cl. ..... 200/61.45 R; 200/61.45 M; 200/61.53

[58] Field of Search ..... 200/61.45 R–61.53

[56] References Cited

U.S. PATENT DOCUMENTS

| | | | |
|---|---|---|---|
| 4,001,185 | 1/1977 | Mitsui et al. | 200/61.45 R |
| 4,097,699 | 6/1978 | Larson | 200/61.45 R |
| 4,329,549 | 5/1982 | Breed | 200/61.45 M |
| 4,873,401 | 10/1989 | Ireland | 200/61.45 M |

*Primary Examiner*—J. R. Scott

*Attorney, Agent, or Firm*—George L. Boller; Russel C. Wells

[57] ABSTRACT

An inertia switch assembly comprises an inertia switch assembly element encapsulated by potting material within a housing. The inertia switch assembly element comprises a non-magnetic enclosure containing an inertial mass and switch contacts. The switch contacts are connected by conductors that become terminals parallel with and spaced radially of the enclosure as they pass through an aperture in the housing. This aperture is closed by a closure on the terminals. Potting material is kept from intruding into the enclosure by a sealed closure which closes an open end of the enclosure and through which the conductors pass. The housing has an integral shroud surrounding the terminals to thereby form a connector plug structure for connetion with a mating connector plug structure leading to a circuit controlled by the switch assembly. The housing also has a triangular-shaped base containing apertures at each apex to provide for attachment of the housing to a wall. The inertial mass is magnetically biased by a magnetic circuit which includes an axially slotted tube disposed around the switch assembly element.

7 Claims, 13 Drawing Sheets

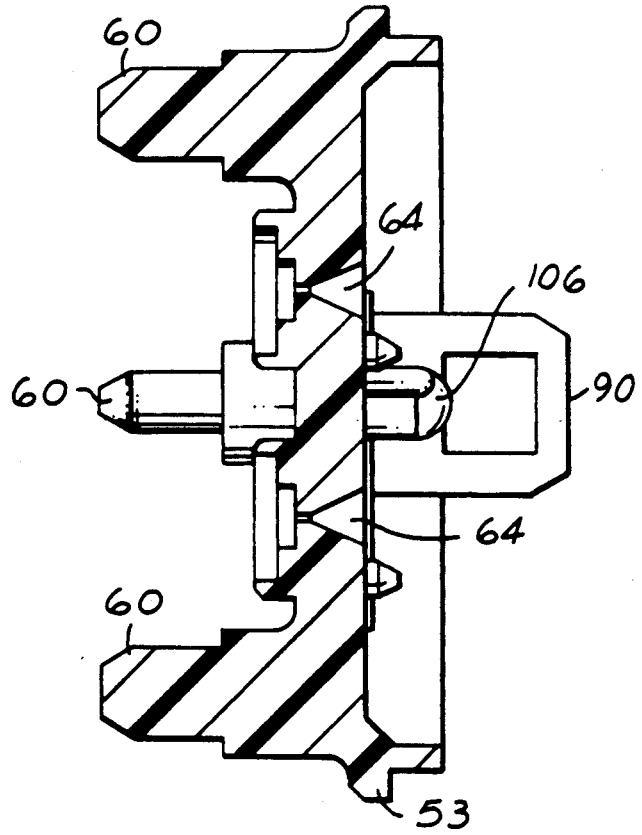
FIG.4
FIG.5
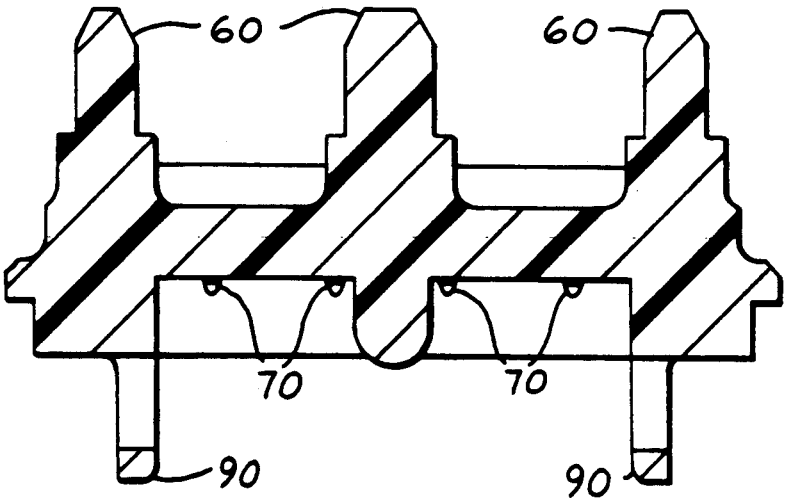

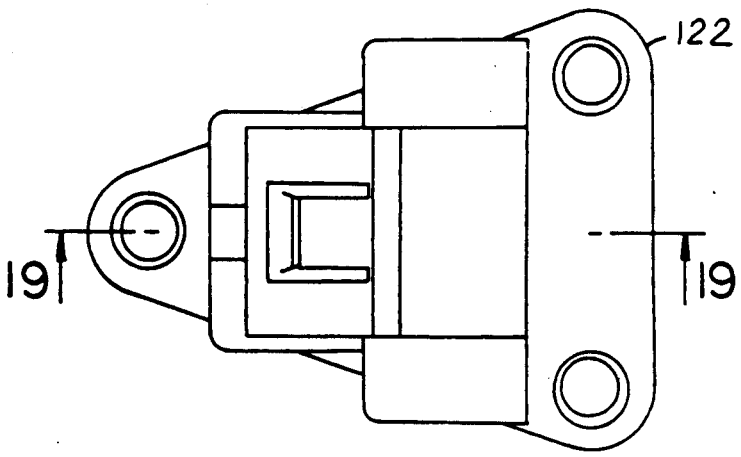
FIG. 18
FIG. 19
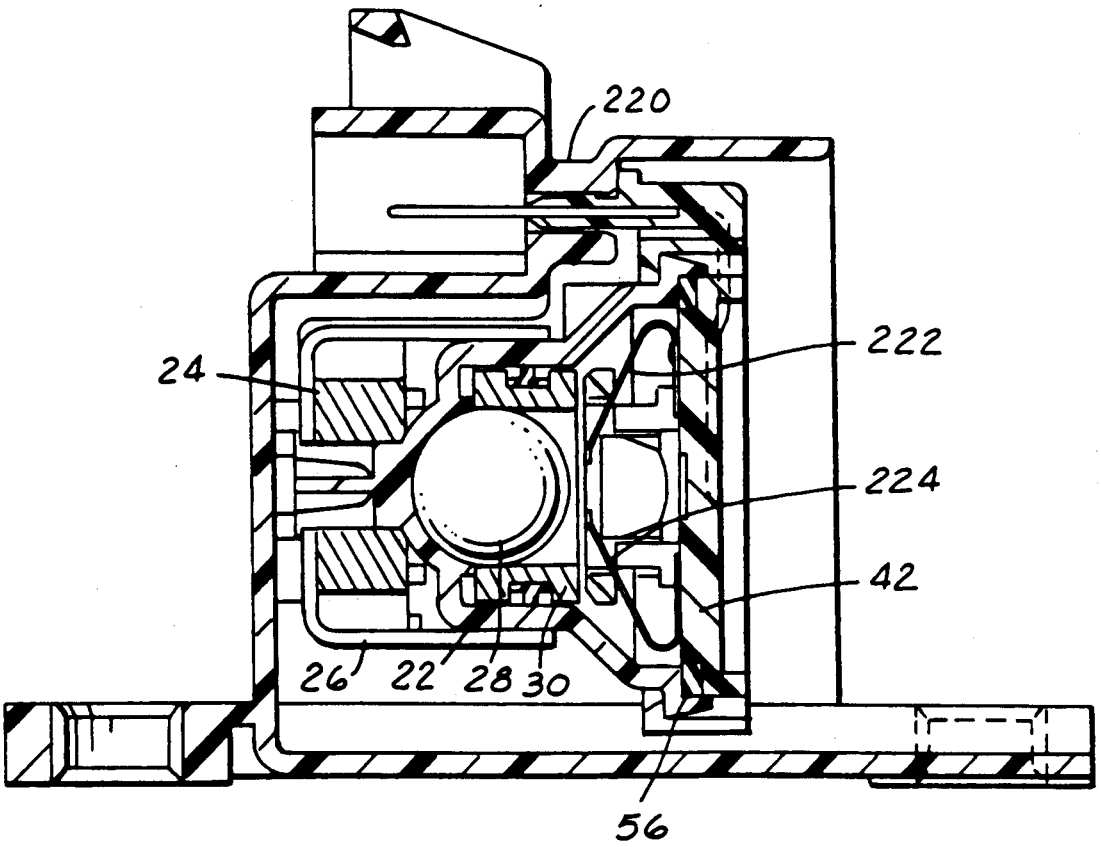

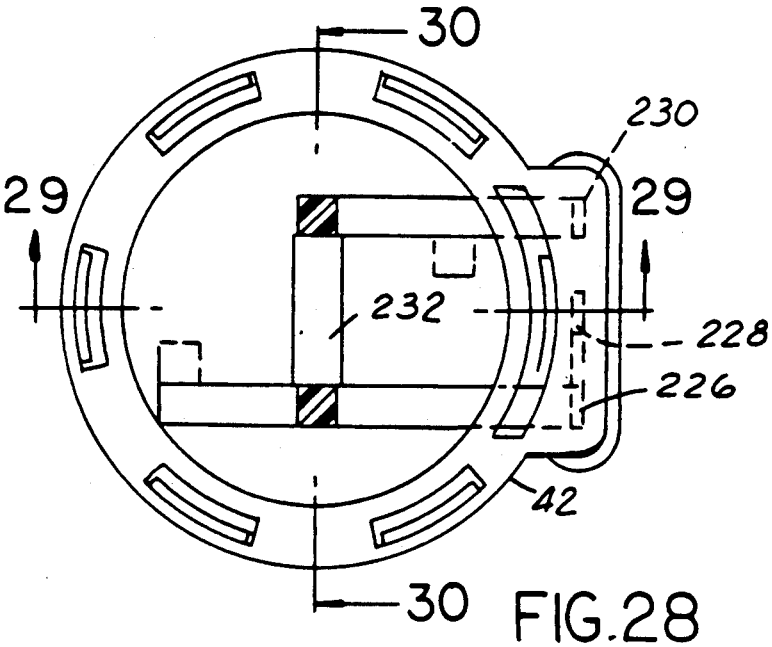
FIG.28
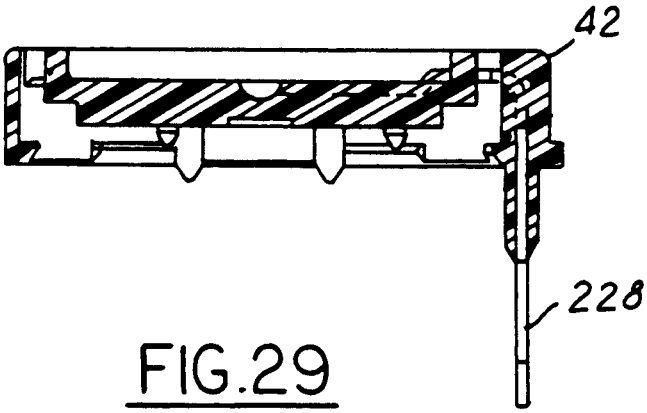
FIG.29
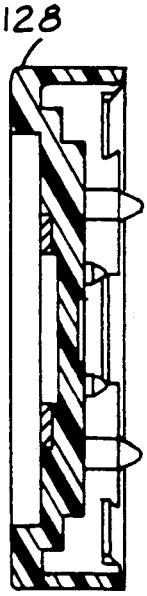
FIG.30
FIG.31
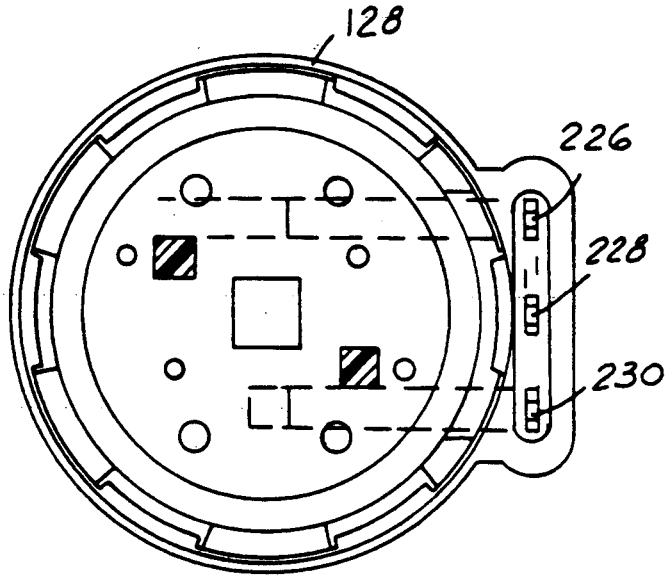

INERTIA SWITCH MOUNTING HOUSING

FIELD OF THE INVENTION

This invention relates generally to inertia switches, particularly to the mounting housings of such switches.

BACKGROUND AND SUMMARY OF THE INVENTION

A supplemental inflatable restraint system in an automotive vehicle comprises one or more supplemental inflatable restraint devices, for example a driver's side air bag and a passenger's side air bag. Each supplemental inflatable restraint device is initiated by its own independent electrical circuit, and each circuit includes an inertia switch which is devoted exclusively to the corresponding supplemental inflatable restraint device.

While suitable mounting location(s) on a vehicle's structure for such switches is (are) typically selected on the basis of a number of factors, one important consideration involves the ability of a mounting location to respond in a consistent manner to impact forces. In order to then secure consistent inertia switch performance in such a location, it becomes necessary to have consistency in the manner in which the switch mounts on the vehicle structure, and consistency in the switch construction itself. Inability to meet either or both of these criteria may give rise to installations in which an inertia switch does not respond in the manner in which it is intended. For mass-production environments, consistency and reliability are promoted by making fabrication and assembly procedures as facile as possible.

Other factors come into play as well. The mechanisms of certain inertia switches may require shielding from certain environmental influences. For one example, in an inertia switch of the type containing a magnet that holds the inertial mass in place during quiescent and normal conditions, shielding of the magnetic circuit from external magnetic forces may be required. For another example, the inertia switch may be located in an area that is exposed to dirt or contamination, and in this case proper protective enclosure of the mechanism is called for. Similarly, if the inertia switch is in a location where it could be tampered with, a tamper-proof or at least a tamper-evident housing should be used to thwart attempted tampering. Still further, the inertia switch should be capable of withstanding substantial impacts so that it can continue to provide proper functioning in the event of receiving such impacts.

The present invention relates to a new and improved mounting housing for an inertia switch that is used to signal a supplemental inflatable restraint operating circuit in a manner that avoids spurious signalling during periods of normal vehicle operation, yet will provide proper signalling at the time that such signalling is intended to occur. The invention possesses a number of novel feature which provide benefit.

One feature is that portions of the circuitry associated with the inertia switch are embodied in a portion of the inertia switch assembly itself. This eliminates the need to use a separate circuit board assembly for the mounting of the circuit components involved. Another feature is the arrangement of an internal seal in such a manner that the potential for outgassing is reduced during a potting operation that is conducted during the fabrication process, and more consistent internal element pressures are attained. A further feature is the arrangement of an internal steel keeper in such a manner that an internal magnetic circuit is suitably shielded from external influences while a more efficient internal magnetic circuit results. Such improvements in the internal magnetic circuit may permit the downsizing of certain internal components with attendant potential for economies in size, weight and cost.

The invention also contemplates improvements in the fabrication process by allowing a pre-filled potting compound to be used in place of a previously used form of potting which was more labor-intensive. Specifically, the invention enables the following operations to be eliminated: epoxy sealing of contacts; element assembly roll-over (because the element assembly is now a snap fit); element de-pressurization; circuit board assembly; soldering of circuit board connections; post-solder defluxing; circuit board conformal coating; manual assembly of element into housing; positioning of foam spacers in housing; glueing of elements and grommets into housing; addition of sand to potting compound; and the vibration/mixing of the sand into the potting. The reduction in the number of operations required to fabricate an inertia switch makes the process more cost-efficient. It also results in reduced variability from part to part. More accurate alignment of the element to the axis of motion makes for improved response to impact.

Further features, advantages and benefits of the invention will be seen in the ensuing descriptions and claims. Drawings accompany the disclosure and illustrate a preferred embodiment of the invention according to the best mode contemplated at the present time in carrying out the invention.

BRIEF DESCRIPTION OF THE DRAWINGS

FIG. 4 is a cross-sectional view taken in the direction of arrows 4—4 in FIG. 3 with the omission of certain parts.

FIG. 5 is a cross-sectional view taken in the direction of arrows 5—5 in FIG. 3 with the omission of certain parts.

FIG. 18 is a plan view of the housing.

FIG. 19 is a cross-sectional view taken along line 19—19 in FIG. 18, an enlarged.

FIG. 28 is a view similar to FIG. 15 but of another embodiment.

FIG. 29 is a cross-sectional view taken along line 29—29 in FIG. 28.

FIG. 30 is a cross-sectional view taken along line 30—30 in FIG. 28.

FIG. 31 is a full bottom view of FIG. 29.

DESCRIPTION OF THE PREFERRED EMBODIMENT

Figure 2:
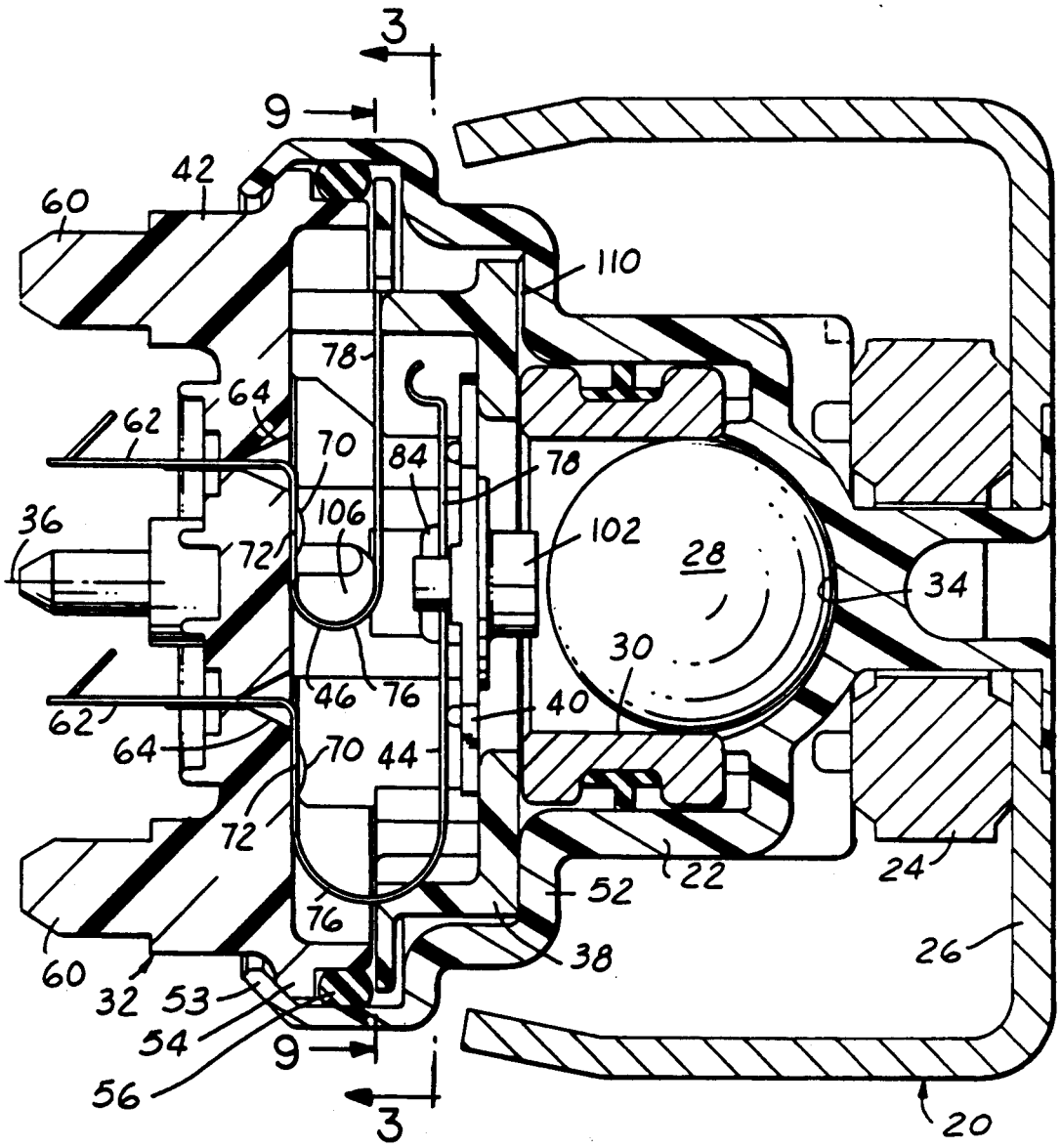
FIG. 2 is a cross-sectional view through FIG. 1 as taken in the direction of arrows 2—2 in FIG. 1 and slightly enlarged.

FIG. 2 shows the organization and arrangement of principal internal components of an inertia switch element assembly 20; namely, a body 22, a magnet 24, a metal keeper 26, a ball 28, a tube 30, and a dual pole switch assembly 32.

Ball 28 is the inertial actuator for switch assembly 32 and the operating principles by which the ball operates to sense a predetermined deceleration characteristic are known in the art. Briefly, ball 28 is of a suitable ferromagnetic material that in the quiescent condition of element 20 is forcefully biased into a cup 34 that is formed centrally in body 22, body 22 being a non-ferromagnetic material (i.e., such as a suitable plastic) that allows the magnetic force to act upon the ball. When the inertia switch assembly element is subjected to a deceleration force of predetermined characteristic along the direction of the element's longitudinal axis 36, ball 28 overcomes the magnetic attractive force to travel within tube 30 leftwardly from the position that is illustrated in FIG. 2. The ball has a closely controlled fit within tube 30 whereby certain dampening is imparted to the ball motion. This produces a particular timing characteristic for the inertia switch assembly element. When the ball has traveled a certain distance from cup 34, it actuates switch assembly 32.

Figure 1:
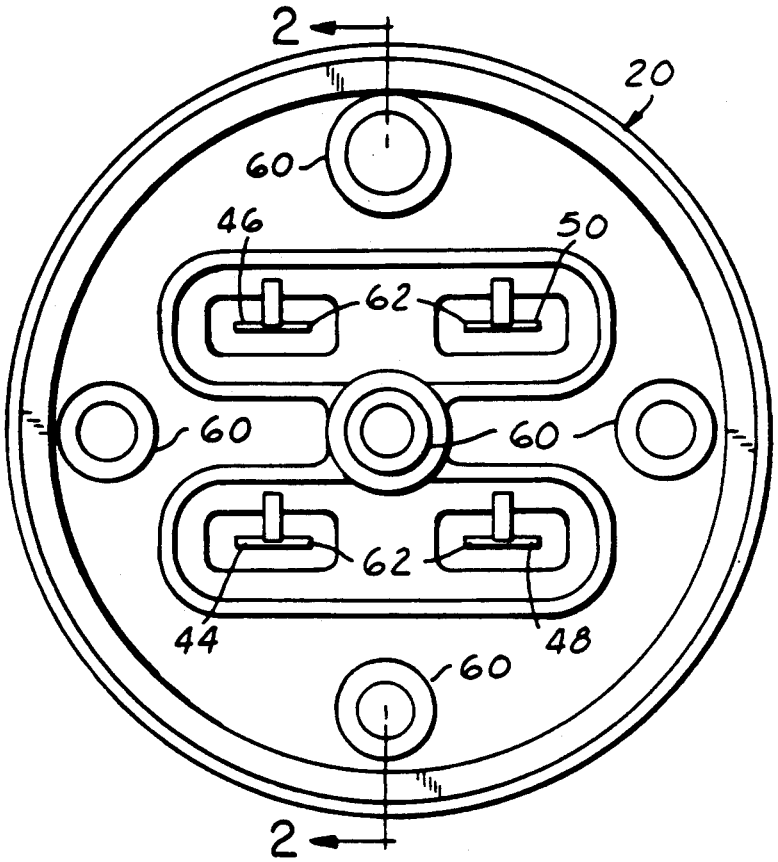
FIG. 1 is an end view of a dual pole inertia switch element assembly for use in a mounting housing in accordance with principles of the invention.
Figure 3:
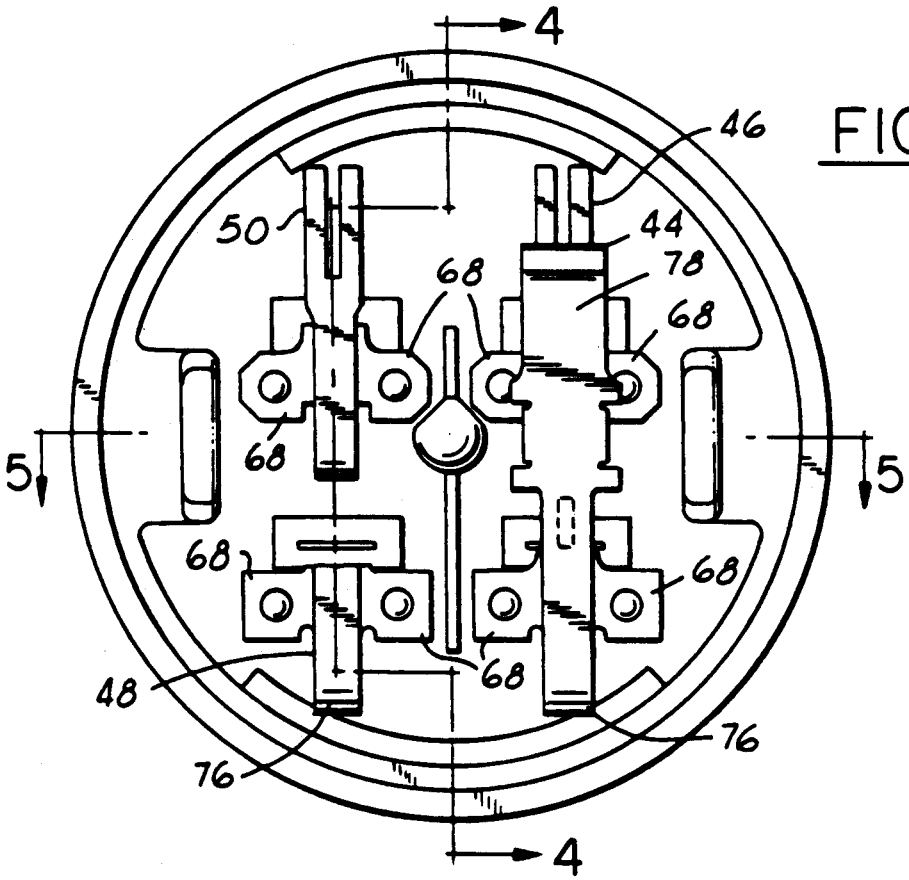
FIG. 3 is a view taken in the general direction of arrows 3—3 in FIG. 2 but on a slightly reduced scale.

Still referring to FIG. 2, switch assembly 32 consists of seven parts that are assembled together to form a dual pole device. These parts are a contact support 38, an actuator disk 40, a ball retainer 42, a first set of contacts consisting of a contact 44 and a contact 46, and a second set of contacts consisting of a contact 48 and a contact 50 (FIGS. 1 and 3). Switch assembly 32 is assembled to the left-hand portion of body 22 as viewed in FIG. 2 by abutting contact support 38 against a shoulder 52 of body 22 and forming the distal end margin 53 of body 22 over a flange 54 of ball retainer 42. An O-ring seal 56 is disposed between switch assembly 32 and the sidewall portion of body 22 that lies immediately adjacent end margin 53.

The parts 38, 40 and 42 are fabricated preferably from a plastic material that can be accurately molded to closely controlled tolerances and that after molding is dimensionally stable. An example of a suitable material is polyester. Other materials may, of course, be used.

Details of ball retainer 42 are illustrated in FIGS. 1 through 5. On the exterior face as viewed in FIG. 1, the ball retainer comprises a pattern of projections 60 that are intended to locate a circuit board (hereinafter described) that assembles onto switch assembly element 32 in the completed device 20. Each contact 44, 46, 48 and 50 has an externally projecting terminal portion 62 via which it is placed in circuit connection with mating terminals on the printed circuit board. It can be seen that ball retainer 42 has suitable throughslots 64 through which the contacts pass between the interior and the exterior of the switch assembly element.

Each of the four contacts 44, 46, 48 and 50 comprises a pair of apertured ears 68 projecting laterally from opposite sides. These ears provide for attachment of the contacts to the interior of ball retainer 42 by means of heat staking. Prior to such heat staking, the ball retainer has a pattern of projections 70 corresponding to the arrangement for the apertured ears 68 and sized to allow the apertured ears to be fitted over them and against the interior wall of the ball retainer. This initial shape for pins 70 can be seen in FIG. 5. After the completion of the heat staking operation, the pins are deformed into heads that hold the contacts in place in the pattern illustrated in FIG. 3. Thus, each of the contacts 44, 46, 48 and 50 may be considered to have a flat mounting portion 72 that is intermediate the corresponding terminal portion 62 and a generally semi-circularly curved portion 76. Each semi-circularly curved portion 76 is intermediate a generally straight beam 78 and the corresponding flat mounting portion 72. Contacts 44 and 48 are identical but of somewhat smaller size than contacts 46 and 50 which are themselves identical. The semi-circularly curved portion 76 is larger in contacts 44 and 48 than it is in contacts 46 and 50. Similarly, the beam 78 is longer in contacts 44 and 48 than it is in contacts 46 and 50.

The drawing FIGS. 1, 2, 3, 14, 15 show all four contacts 44, 46, 48 and 50 in flexed conditions. In their free, unstressed conditions, the beams 78 of each contact would point generally toward the upper right-hand corner of the drawing FIG. 2 so that each would lie generally at an obtuse angle with respect to the corresponding terminal portion 62. The flexion of each beam 78 from the unstressed condition to that of FIG. 2 takes place essentially about the center of curvature of the corresponding semi-circularly curved portion 76.

In the assembly, the free end of the beam 78 of each contact 46 and 50 projects beyond the distal end of the beam 78 of the corresponding contact 44, 48. The distal end of the beam 78 of each contact 44, 48 has a rounded hook-shape that is rounded toward the beam of the corresponding contact 46, 50. As can be seen from FIG. 3, the beams 78 of contacts 44 and 46 are parallel and overlapping, as are the beams 78 of contacts 48 and 50. Also the distal end portion of the beam 78 of each contact 44, 48 is wider than the underlying beam portion 78 of the corresponding contact 46, 50. It is further to be observed that the distal end of the beam 78 of each contact 46, 50 is a bifurcation that forms a pair of spaced-apart tines. This bifurcated portion has an overall width that exceeds that of the portion of the same beam that joins with the corresponding semi-circular portion 76.

Figure 9:
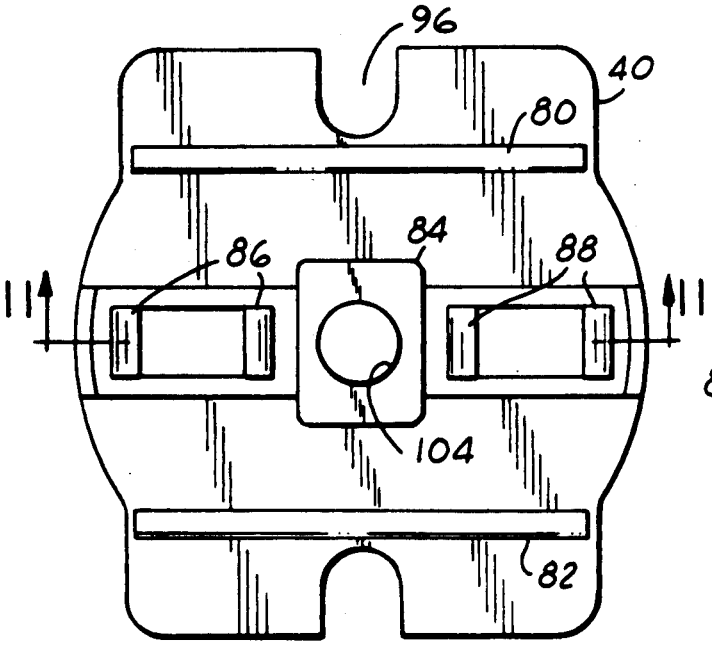
FIG. 9 is an axial view of another of the component parts shown by itself as taken substantially along line 9—9 in FIG. 2.
Figure 10:
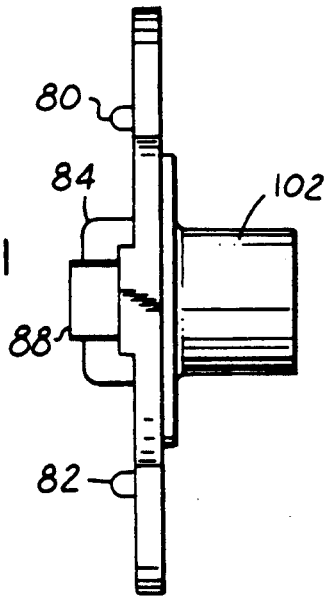
FIG. 10 is a right side view of FIG. 9.
Figure 11:
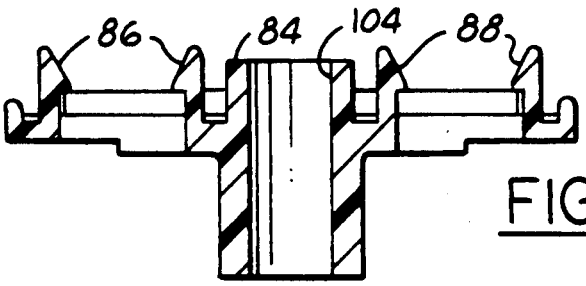
FIG. 11 is a cross-sectional view taken in the direction of arrows 11—11 in FIG. 9.

In switch assembly 32, disk 40 is assembled to the beams 78 of contacts 44 and 48. Details of disk 40 can be seen in FIGS. 9, 10 and 11 in addition to FIG. 2. The beam 78 of each contact 44, 48 bears against disk 40 at two spaced-apart locations that are established by parallel rounded ridges 80 and 82 in the disk. Located to either side of a central rectangular shaped boss 84, are a pair of spaced-apart catches 86 and 88. The central portion of each beam 78 of contacts 46 and 50 is retained on disk 40 by snapping into the corresponding pair of catches 86, 88. For retention purposes, the catches are designed in relation to ridges 80 and 82 such that the beam 78 of each contact 46, 50 is slightly bowed or flexed so as to be very slightly concave in the direction toward ball retainer 42.

Figure 6:
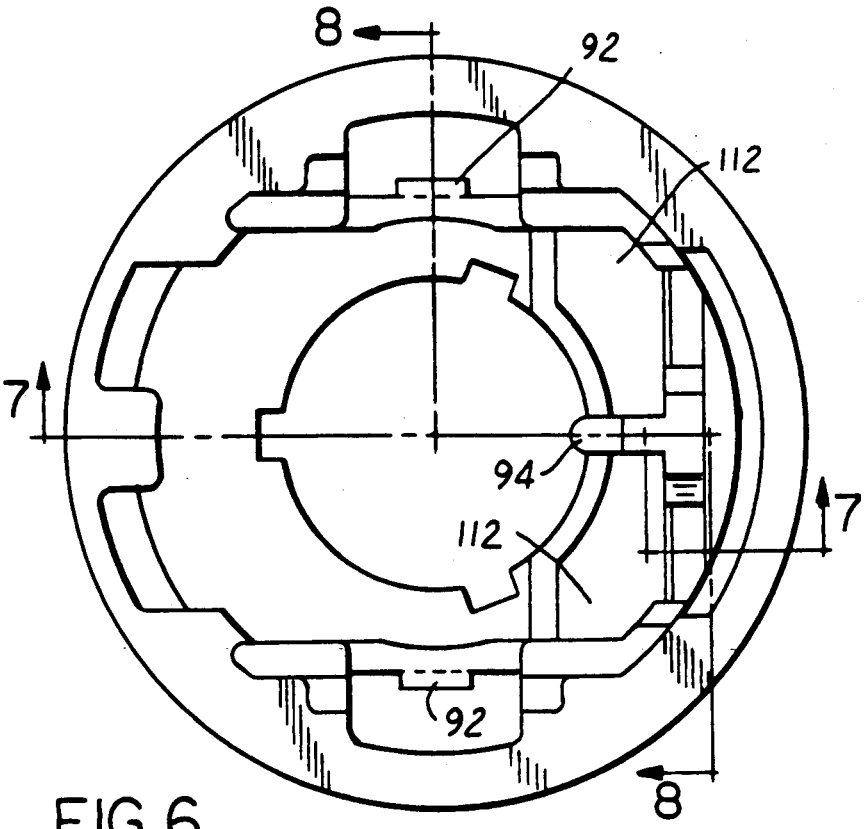
FIG. 6 is an axial view of one of the component parts of FIG. shown by itself.
Figure 8:
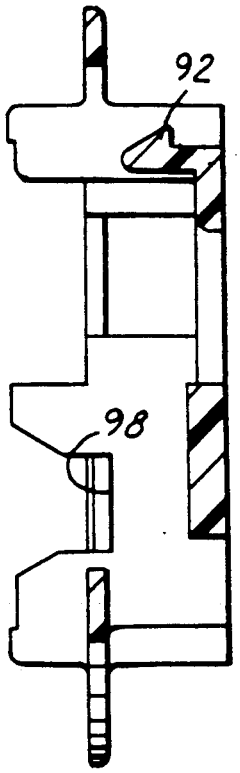
FIG. 8 is a cross-sectional view taken generally along line 8—8 in FIG. 6.

After disk 40 has been assembled to contacts 46 and 50, it becomes possible to assemble ball retainer 42 and contact support 38. As can be seen in FIGS. 2, 4 and 5, ball retainer 42 comprises two apertured axially projecting tabs 90 on opposite sides. Contact support 38 has a pair of catches 92 on opposite sides (see FIGS. 6 and 8) that are adapted to snap into the apertured tabs 90 when the two parts 38 and 42 are aligned with each other and pushed together. During the process of joining the two parts 38 and 42 in assembly, the interior of part 38 will engage disk 40 and deflect all four of the contacts 44, 46, 48, 50 from their unstressed conditions until such time as the two parts 38, 42 snap together, at which time contact 44 is disposed relative to contact 46 in the manner portrayed in FIG. 2 while contacts 48 and 50 are similarly related.

Contact support 38 is formed with an axially extending guide rail 94 that serves to locate and guide disk 40 by fitting into a slot 96 in the periphery of the disk. The axial wall of contact support 38 also contains a pair of locators 98 for locating the distal ends of the beams 78 of contacts 46 and 50. Each locator is shaped to have a knife edge 100 on which the beam bears. The locators serve to locate the beams of contacts 46 and 50 laterally for respective alignment with the beams of contacts 44 and 48, and they also serve to locate the beams of contacts 46 and 48 along axis 36.

The nature of the design is such that in the assembly, the distance between the beams of contacts 44 and 46 is made to equal that between the beams of contacts 48 and 50 by controlling the dimensions of only the two parts 38 and 40. The amount of travel that ball 28 will experience before engagement with disk 40 is determined by the axial dimension of a circular boss 102 that is centrally formed on the face of the disk opposite boss 84. A circular throughhole 104 is provided centrally in the disk as an aid to the interaction of the ball with the end of boss 102 when the ball strikes the actuator.

Operation of the device is as follows. When subjected to a deceleration force along axis 36 of predetermined characteristic, ball 28 will travel toward disk 40. Upon abutting boss 102, the ball will drive the disk toward ball retainer 42, further flexing contacts 44 and 48 from the position of FIG. 2, such flexing taking place about the centers of the curved sections 76. The rounded hooked ends of the beams of contacts 44 and 48 will contact the bifurcated ends of the beams of contacts 46 and 50 causing independent circuit continuities to be established between contacts 44 and 46 on the one hand and between contacts 48 and 50 on the other hand. The beams of contacts 46 and 50 will now also begin to increasingly flex about their respective curved portions 76. Contact flexing will continue until the motion of the disk and ball is arrested by abutment of boss 84 with the rounded nose of a stop 106 of ball retainer 42.

The two sets of contacts are thereby operated in a uniform manner to cause two independent signals to be given in a highly simultaneous manner. Because short travel distances may be used for ball 28 and the mass of the ball may be small, it is important to minimize the influence of the contacts on the inertia of the ball, and this calls for the contacts, even though resilient, to be quite flimsy. Without more, flimsy contacts can be quite sensitive to ordinary vibrations which occur in normal use of an automotive vehicle. These requirements are seemingly inconsistent for an inertia switch that must successfully distinguish between acceptable vibrations and the occurence of a true need for switch actuation, but the illustrated construction reconciles these inconsistencies in a remarkable manner. Neither contact of each set will vibrate toward the other in a manner that would cause spurious switch actuation; yet when the time for switch actuation occurs, the actuation proceeds in a manner that provides suitable contact action for carrying the required current for the required duration. The manner of yielding of the beams tends to avoid contact bounce, and the particular shapes of the ends of the beams promote the attainment of good electrical contact. Because of the manner in which each of the two larger contacts is kept in alignment with the corresponding smaller contact, the larger contacts will not miss their targets when the switch assembly element is actuated.

Figure 7:
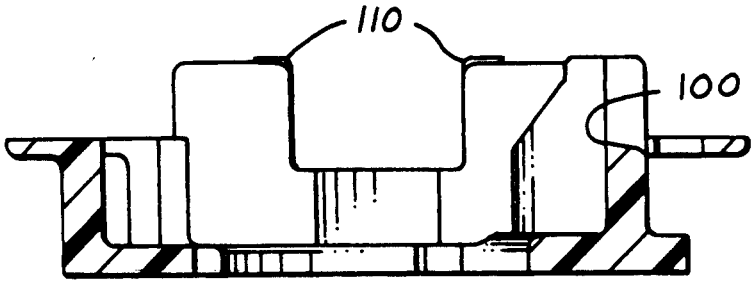
FIG. 7 is a cross-sectional view taken generally along line 7—7 in FIG. 6.

Certain specific details in the execution of the illustrated embodiment represent known fabrication practices. For example, in a molded plastic part it may be difficult to precisely control surface flatness around a surface of revolution or any other surface of appreciable area; therefore a known fabrication practice comprises the use of spaced apart locating pads or limited-area locators, such as indicated at 110, and 112 (See FIGS. 7, 8, and 9).

Figure 13:
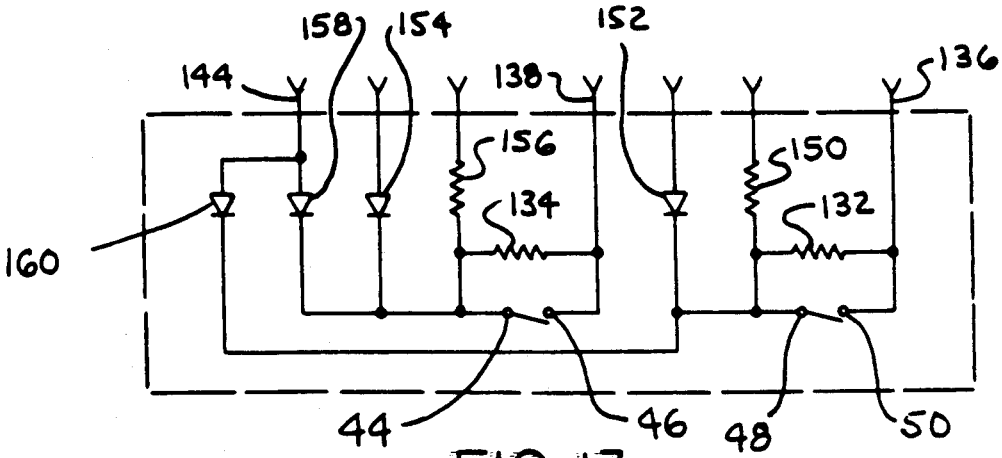
FIG. 13 is an electrical schematic diagram of the circuit board shown in FIG. 12.
Figure 12:
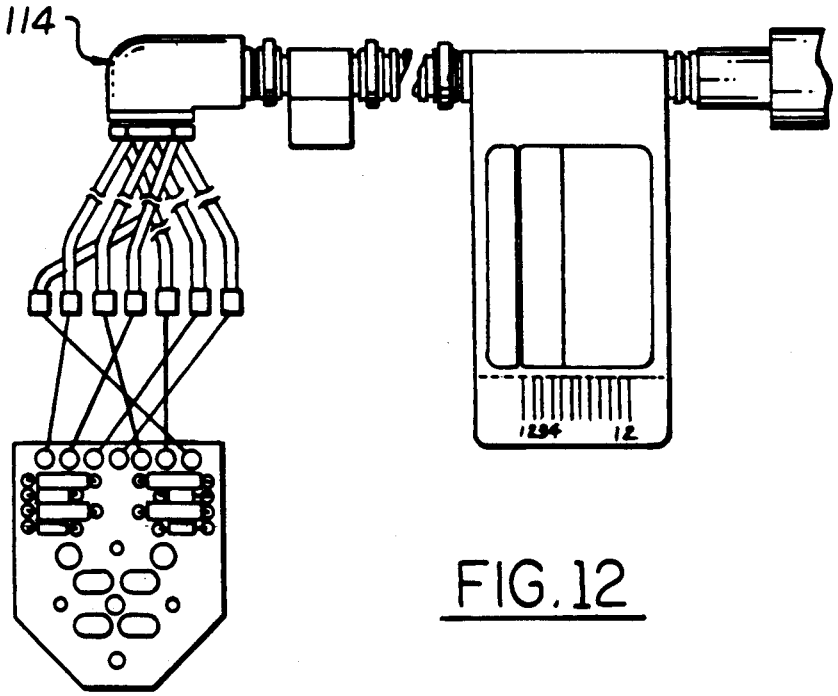
FIG. 12 is a view illustrating a circuit board and wire harness assembly that is intended for use with the switch assembly.

The circuit board and wire harness 114 that connects to the terminal portions of the contacts is shown in FIG. 12. The schematic is depicted by FIG. 13. The circuit is intended to secure true circuit isolation between the two poles of switch assembly 32 so that a fault in one circuit will not automatically create one in the other.

Figure 14:
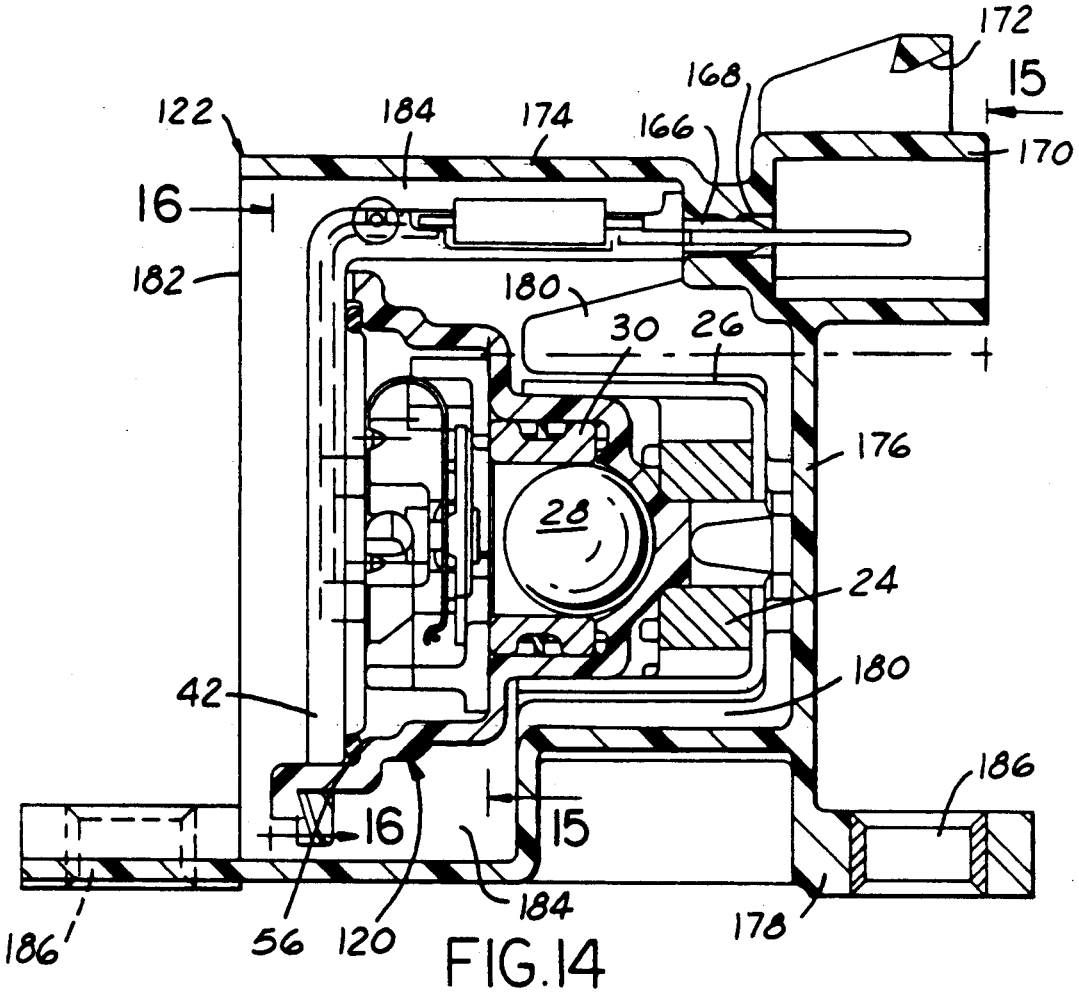
FIG. 14 is a cross-sectional view through a switch element mounted in a housing, the switch element being slightly different from that of FIG. 2.

Before the completed inertia switch assembly element is put to use, it is placed within a mounting housing and potted. FIGS. 14–17 present a similar dual pole switch assembly element 120 in association with a mounting housing 122. Like reference numerals from the previous drawing Figs. are used to designate like parts in FIGS. 14–17. Element 120 differs from element 20 in the following ways. The axial sidewall of keeper 26 is straight throughout in FIG. 14. The end of body 22 that is closed by ball retainer 42 is shaped somewhat differently to accept a differently shaped ball retainer. The ball retainer of FIG. 14 is shaped, not for acceptance of a printed circuit board, as in the earlier description, but rather to obviate the need for a circuit board through the integration of the electrical circuit components shown in FIG. 13 into the element 120/mounting housing 122 assemblage portrayed in FIG. 14. Also, seal 56 takes the form of an axial seal, rather than the radial seal in FIG. 2, and this provides a sealing of the interior of element 120 which reduces the potential for gassing off through the potting compound when the element is being potted in the mounting housing, and promotes more uniformity in the internal pressure within the sealed enclosure of the moving parts from unit to unit.

Figure 15:
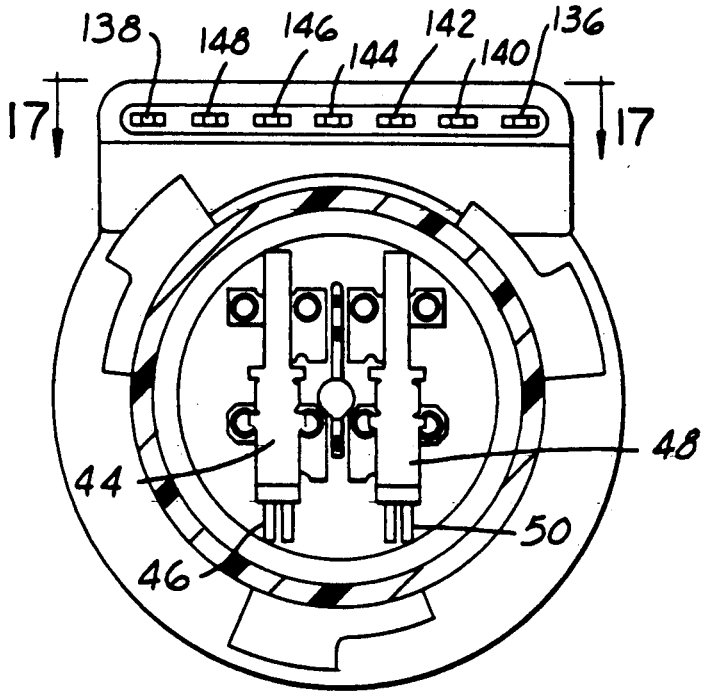
FIG. 15 is a view taken generally along line 15—15 in FIG. 14, certain portions being omitted.
Figure 16:
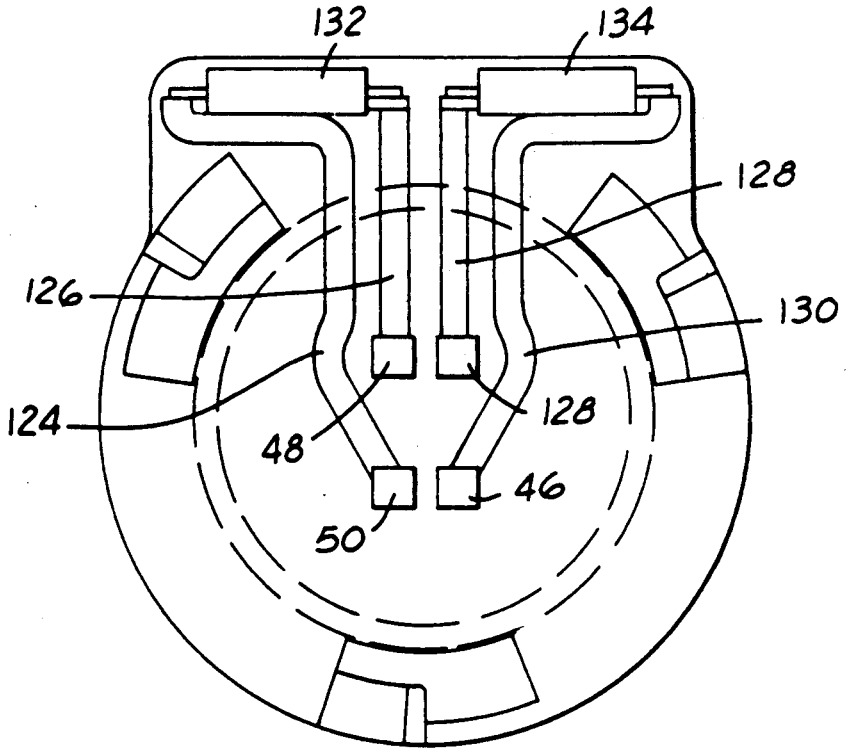
FIG. 16 is a view taken generally along line 16—16 in FIG. 14, certain portions being omitted.
Figure 17:
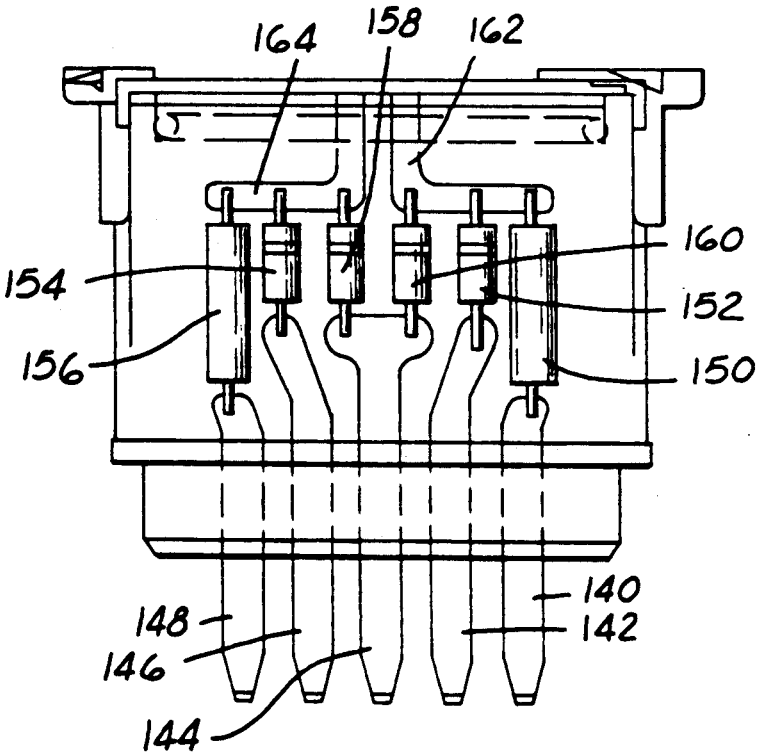
FIG. 17 is a view taken generally along line 17—17 in FIG. 15, certain portions being omitted.
Figure 20:
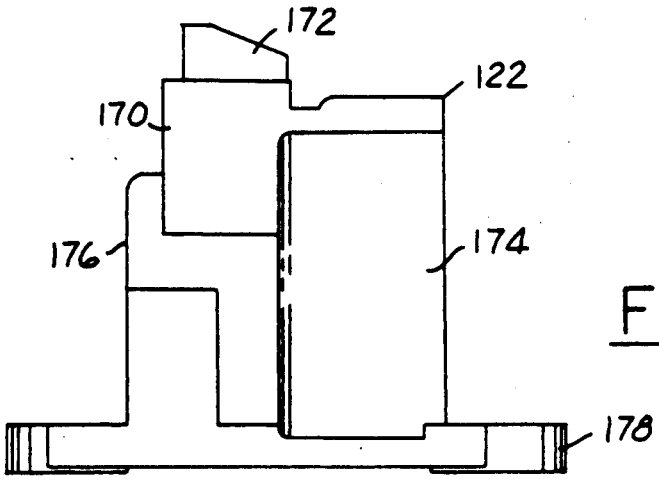
FIG. 20 is a front view of FIG. 18.
Figure 21:
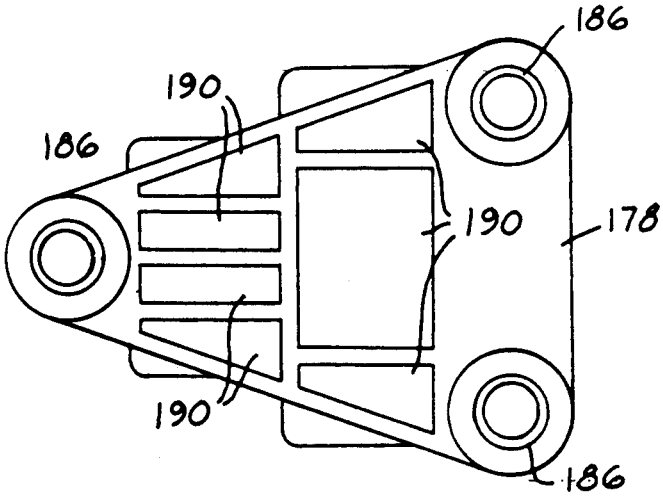
FIG. 21 is a bottom view of FIG. 18.
Figure 22:
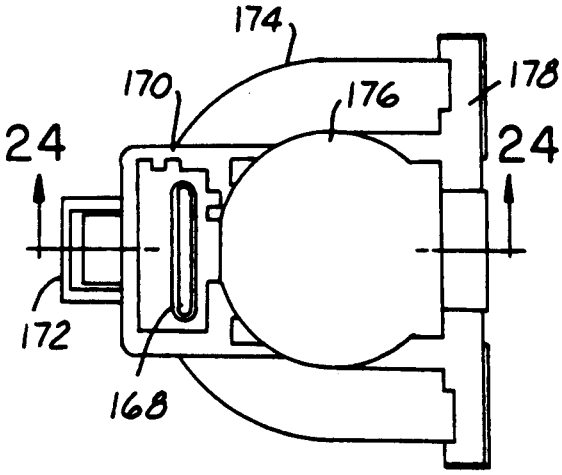
FIG. 22 is a leftside view of FIG. 20, rotated on the sheet ninety degrees counterclockwise.

FIG. 15 reveals that the internal appearance of the contacts 44, 46, 48, 50 is the same as in FIG. 3. However, they terminate within the wall of the ball retainer instead of passing through. Their pattern can be seen in FIG. 16. Each contact is connected by a corresponding conductor 124, 126, 128, 130 to a corresponding termination of one of two resistors 132, 134 which are disposed in spaced apart alignment in a somewhat tangential fashion relative to ball retainer 42. These conductors and resistors are embedded within ball retainer 42. These two resistors are the ones in FIG. 13 that shunt the respective switch contacts.

Disposed at a right angle to the junction of conductor 124 and resistor 132 is a conductor leading to a terminal 136; similarly, a conductor extending at a right angle to the junction of conductor 130 and resistor 134 leads to a terminal 138. Terminals 136 and 138 lie at the far ends of a row of seven parallel terminals comprising the additional terminals 140, 142, 144, 146, and 148. Terminals 136 and 138 are omitted from FIG. 17 for clarity. Each of the five terminals 140, 142, 144, 146, 148 is partially embedded in the ball retainer and with the exception of terminal 144 makes connection with one side of a corresponding embedded circuit element 150, 152, 154, and 156. Terminal 144 connects to two embedded circuit elements 158 and 160. The opposite sides of circuit elements 150, 152, and 160 are connected in common with an embedded conductor 162 that connects to the junction of resistor 132 and conductor 126; the opposite sides of circuit elements 154, 156, and 158 are connected in common with an embedded conductor 164 that connects to the junction of resistor 134 and conductor 128. The arrangement that has just been described is defined by the electrical schematic of FIG. 13.

The ball retainer is insert molded onto the electrical circuit components just described so that all are embedded with the molding material except for the exposed terminals 136–148. The material of the ball retainer is suitably formed in relation to the terminals so that an enlargement 166 results. This enlargement provides for an interference fit with a throughslot 168 in mounting housing 122 to allow the exposed terminals 136–148 to protrude through and enter a shroud 170 in the mounting housing so that a connector plug formation results. This formation mates with a complementary wiring harness connector (not shown) to place the dual pole switch and the associated embedded circuit components in circuit with the remainder of the supplemental inflatable restraint system's electrical circuit. A catch 172 is integrally molded on the exterior of shroud 170 to provide for a locking connection with the complementary connector.

Mounting housing is a part that is molded of suitable plastic material. It has a general cup shape comprising an axial sidewall 174 and an end wall 176 that is supported on an integral base 178 that is shown by way of preferred example to be of triangular shape. The interior of the mounting housing is arranged in a manner to receive the switch assembly element. On the inside of end wall 176 are a series of circumferentially spaced apart fins 180 that project radially and axially inwardly to define a cylindrical receiving space for snugly receiving the cylindrically shaped keeper 26 when the assembly element is inserted into the interior of the housing via the far open end 182 of the housing. As insertion of the assembly element is being conducted, the terminals 136–148 pass through throughslot 168, and in the full inserted position that is depicted by FIG. 14, the enlargement 166 occupies the throughslot. The insertion process can be easily conducted, and when completed, proper seating of the assembly element within the mounting housing is assured.

The portion of sidewall 174 that is axially co-extensive with the portion of body 22 that is beyond keeper 26 has radially spacing to the body to leave a suitable interior space 184 that can be filled with potting material during the potting process. The potting process is conducted by orienting the mounting housing such that the open axial end 182 is pointing up. Introduction of flowable potting material into the cup will fill the free space 184 to thereby encapsulate the assembly element within the housing upon curing of the potting. Because ball retainer 42 axially compresses seal 56, the interior of the assembly element is well-sealed. Potting material will not intrude, and the potential for the element to gas off during the potting process is reduced.

The use of a triangular base 178 provides for the attainment of a sturdy three-point mounting when the device is properly mounted in a vehicle. Each apex of the triangular-shaped base is an attachment point by providing a metal-sleeve-lined hole 186. The base is placed against the vehicle mounting surface and fasteners (not shown) are passed through the holes and properly torqued. The connection of the wiring harness connector can then be made.

Figure 23:
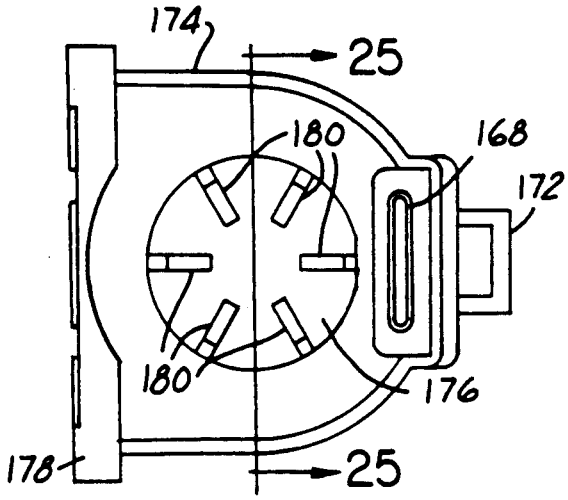
FIG. 23 is a rightside view of FIG. 20, rotated on the sheet ninety degrees clockwise.
Figure 24:
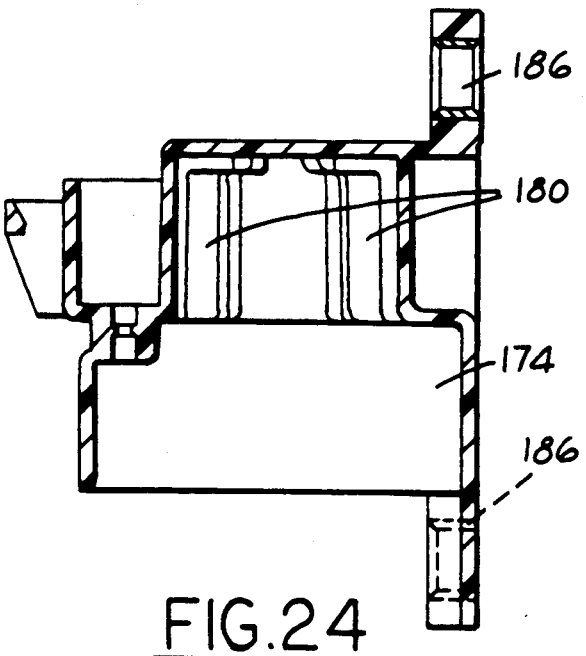
FIG. 24 is a cross-sectional view taken along line 24—24 in FIG. 22.
Figure 25:
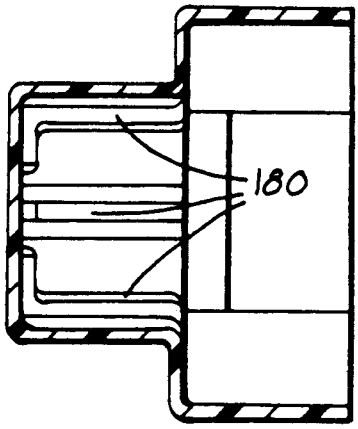
FIG. 25 is a cross-sectional view taken along line 25—25 in FIG. 23.

FIGS. 18–25 illustrate further detail of mounting housing 122. In addition to the portions of the mounting housing which have already been described, FIG. 21 reveals that the face of triangular base 178 that is adapted to be disposed against a mounting surface of the vehicle comprises a series of pads 190 of various shapes. These pads are included to provide for the best overall flatness of the base in the preferred fabrication of the mounting housing by injection molding. The metal sleeves for lining the mounting holes are assembled to the completed molding, or the molding can be insert-molded around them. FIG. 23 clearly reveals the presence of six fins 180 arranged sixty degrees apart.

Figure 34:
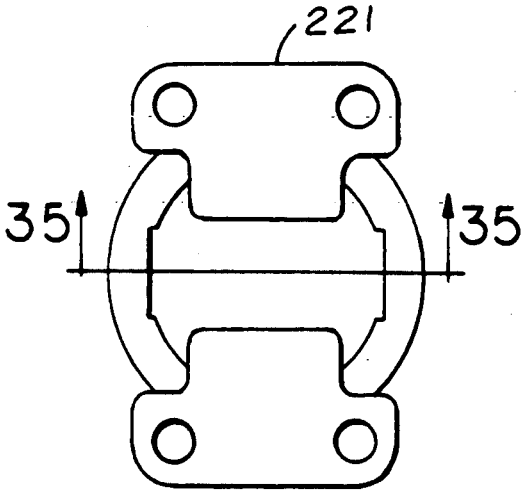
FIG. 34 is an axial end view of a portion of FIG. 19.
Figure 35:
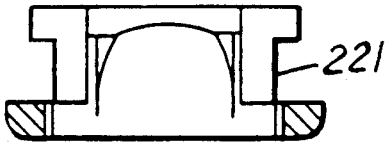
FIG. 35 is a view in the direction of line 35—35 in FIG. 34.
Figure 36:
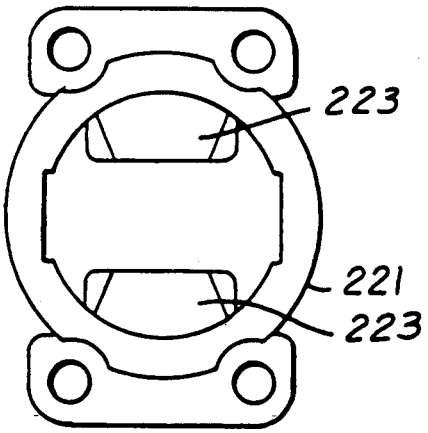
FIG. 36 is an opposite axial end view of FIG. 34.

FIG. 19 reveals still another embodiment for the assembly element that is disposed within mounting housing 122. This embodiment is designated by the general numeral 220 and the parts thereof which correspond to parts of the earlier embodiments previously described are identified by like reference numerals. The embodiment 220 differs from the earlier ones in that its switch assembly 32 is a single pole device. It has a pair of spaced apart contacts 222, 224 that appear in FIG. 19 to have what may generally be considered as hairpin shapes. One portion of each contact is disposed against ball retainer 42 while the beam portions of the contacts are supported at an angle by a contact support 221 which is staked to the ball retainer and serves to prestress the contacts to predetermined spaced relation to ball 28. When ball 28 travels toward the contacts, it bridges the free ends of the beams to establish circuit completion between the contacts for giving the switch signal. The contact support is shaped with concave wall portions 223 to allow the ball to deflect the beams a certain amount before they arrest ball motion. FIGS. 34, 35, and 36 show the details of the contact support 221. In this embodiment, ball retainer 42 snap attaches to body 22 axially compressing seal 56.

As further illustrated by FIGS. 28–31, ball retainer 42 has a different configuration which is adapted to provide only three terminals 226, 228 and 230 for connection with the supplemental inflatable restraint's electrical circuit. Terminals 226, 228 are in common and lead to one of the two contacts 222, 224 while the other terminal 230 leads to the other contact. A resistor 232 bridges the imbedded portions of the connections so as to be in parallel circuit relationship with the switch contacts. In view of the particular shapes for the contacts, suitable mounting accommodations are made to ball retainer 42. The construction that is depicted by FIGS. 28–31 is generic with the corresponding portion of the dual pole configuration in that both contain embedded electrical circuit components, around which the ball retainer is injection molded. Likewise, there is a difference in the configuration for snap attaching the ball retainer to the contact support when compared with assembly element 20, as is true also in the case of assembly element 120.

Figure 26:
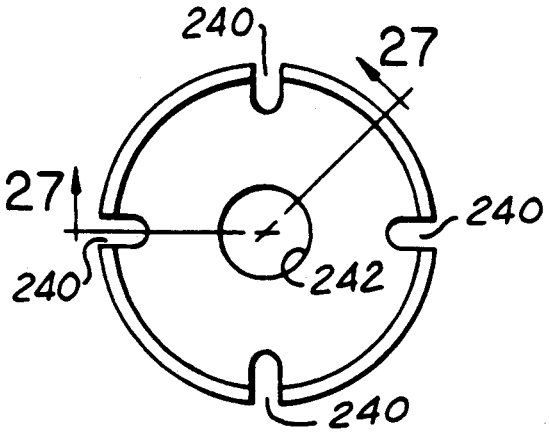
FIG. 26 is an axial end view of one of the parts shown in FIG. 19.
Figure 27:
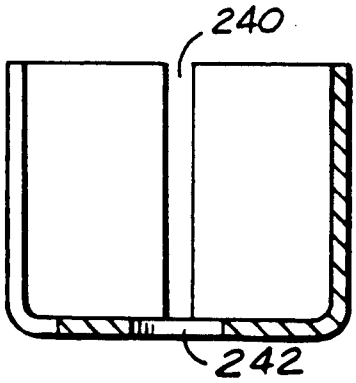
FIG. 27 is a cross-sectional view taken along line 27—27 in FIG. 26.

FIGS. 26 and 27 disclose further detail of keeper 26 showing the presence of four axial slots 240 in the sidewall and spaced ninety degrees apart. It can also be seen that there is a central circular hole 242 in the keeper end wall. The organization and arrangement of the keeper relative to ball 28 makes for an efficient magnetic circuit. The central hole 242 provides a means of attachment of body 22 to the keeper as can perhaps be best seen in FIG. 2.

Figure 32:
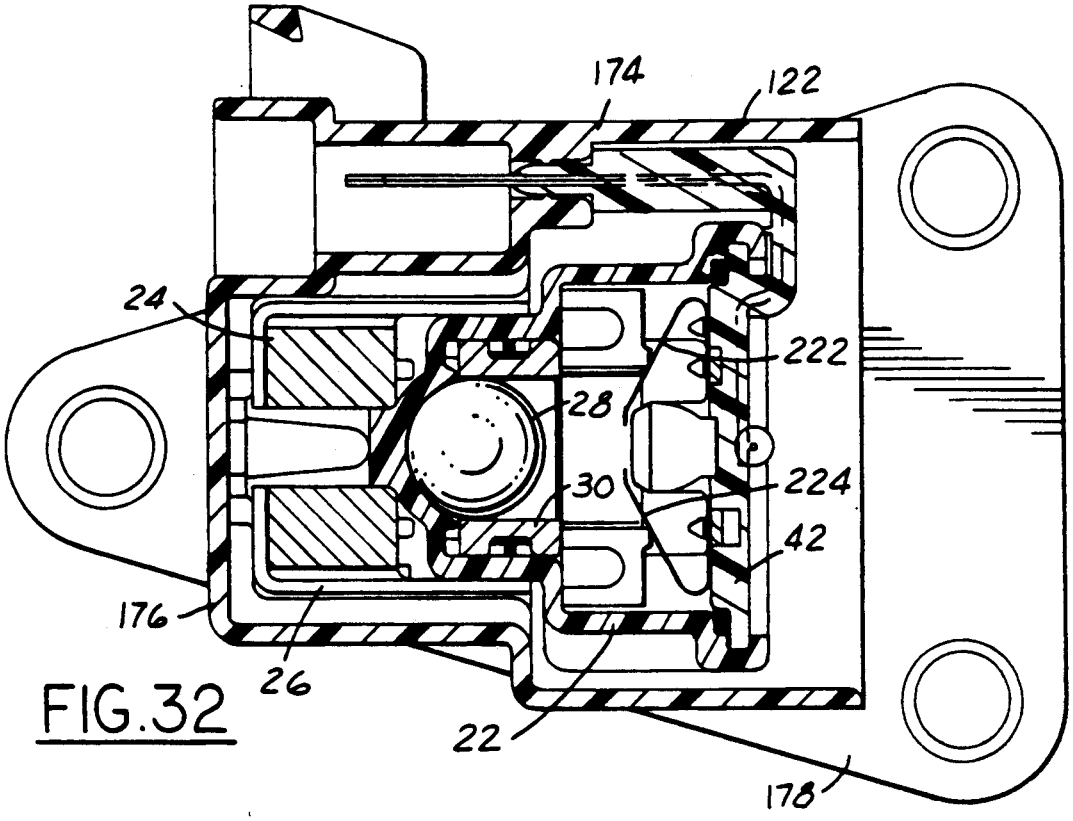
FIG. 32 is a cross-sectional view through yet another embodiment.

FIG. 32 shows an assembly that is identical to that of FIG. 2 except that the triangular shaped base is disposed ninety degrees from its position in FIG. 19. This demonstrates the versatility that is available in fabricating the housing to fit particular vehicle installations.

Figure 33:
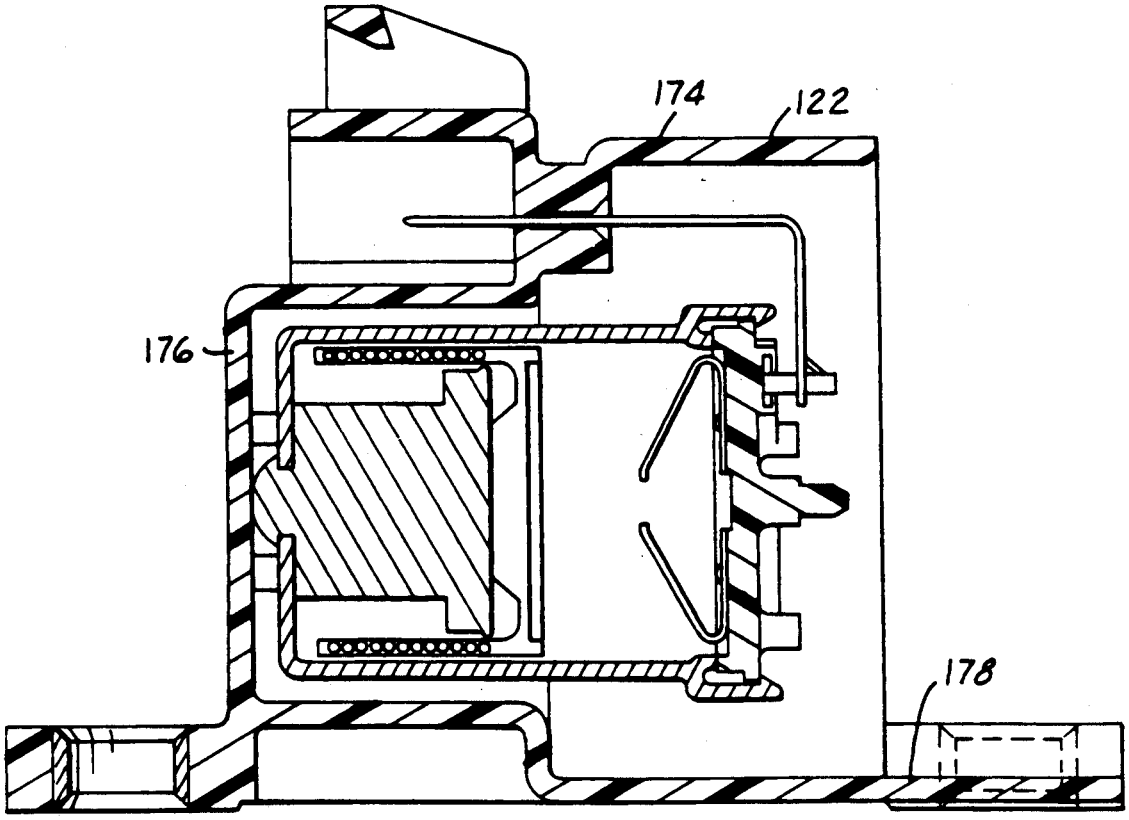
FIG. 33 is a cross-sectional view through yet another embodiment.

FIG. 33 shows still another embodiment which has a housing constructed in accordance with the inventive principles but in which the assembly element embodies a different operating principle from that of the previous embodiments. The assembly element that is disposed within the housing of FIG. 33 is an electromagnetically damped type of inertia switch such as disclosed in commonly owned U.S. Pat. No. 4,873,401 and illustrated in FIGS. 4 and 5 of the patent. This demonstrates that the mounting housing's inventive principles are independent of the particular switch assembly element that is disposed in it.

While a preferred embodiment has been disclosed, it should be appreciated that the inventive principles which are defined by the following claims may be incorporated in other equivalent embodiments.

What is claimed as the invention is:

1. In an inertia switch assembly of the type in which an inertia switch assembly element is disposed within a mounting housing and at least partially encapsulated therein by potting material, said inertia switch assembly element comprising an enclosure containing both an inertial mass that moves within said enclosure in response to the inertia switch assembly being subjected to certain velocity change and electrical contacts that are operated by said inertial mass to give a switch signal in response to motion of said inertial mass within said enclosure caused by said certain velocity change, the improvement which comprises said enclosure having an open end that is closed by a closure assembly which includes both a closure and an electrical conductor means via which said electrical contacts are placed in conducting relationship with an electrical terminal means which is accessible from the exterior of said mounting housing, sealing means that is axially captured between said open end of said enclosure and said closure assembly to prevent the intrusion of potting material into said enclosure, said electrical terminal means is integrally formed with said electrical conductor means so as to be disposed by said electrical conductor means in axially overlapping and radially outwardly spaced relationship to said enclosure, said mounting housing comprises a radially disposed wall portion which comprises aperture means through which said electrical conductor means passes to said electrical terminal means, and closure means on said electrical conductor means closing said aperture means.

2. In an inertia switch assembly of the type in which an inertia switch assembly element is disposed within a mounting housing and at least partially encapsulated therein by potting material, said inertia switch assembly element comprising an enclosure containing both an inertial mass that moves within said enclosure in response to the inertia switch assembly being subjected to certain velocity change and electrical contacts that are operated by said inertial mass to give a switch signal in response to motion of said inertial mass within said enclosure caused by said certain velocity change, the improvement which comprises said enclosure having an open end that is closed by a closure assembly which includes both a closure and an electrical conductor means via which said electrical contacts are placed in conducting relationship with an electrical terminal means which is accessible from the exterior of said mounting housing, sealing means that is axially captured between said open end of said enclosure and said closure assembly to prevent the intrusion of potting material into said enclosure, and said mounting housing includes an integral shroud disposed around and in cooperative relationship with said electrical terminal means so as to form a connector plug structure which can be connected with a mating connector plug of a wiring harness to connect the inertia switch assembly element with an associated electrical circuit.

3. In an inertia switch assembly of the type in which an inertia switch assembly element is disposed within a mounting housing and at least partially encapsulated therein by potting material, said inertia switch assembly element comprising an enclosure containing both an inertial mass that moves within said enclosure in response to the inertia switch assembly being subjected to certain velocity change and electrical contacts that are operated by said inertial mass to give a switch signal in response to motion of said inertial mass within said enclosure caused by said certain velocity change, the improvement which comprises said enclosure having an open end that is closed by a closure assembly which includes both a closure and an electrical conductor means via which said electrical contacts are placed in conducting relationship with an electrical terminal means which is accessible from the exterior of said mounting housing, sealing means that is axially captured between said open end of said enclosure and said closure assembly to prevent the intrusion of potting material into said enclosure, and said mounting housing comprises an integral triangular shaped base via which said mounting housing can be mounted on a wall, said base comprising a metal sleeved aperture at each apex of the base through which a fastener can be passed for mounting said mounting housing on a wall.

4. In an inertia switch assembly of the type in which an inertia switch assembly element is secured within a mounting housing, said inertia switch assembly element comprising an enclosure containing both an inertial mass that moves within said enclosure in response to the inertia switch assembly being subjected to certain velocity change and electrical contacts that are operated by said inertial mass to give a switch signal in response to motion of said inertial mass within said enclosure caused by said certain velocity change, the improvement which comprises said inertia switch assembly element having an electrical conductor means via which said electrical contacts are placed in conducting relationship with an electrical terminal means which is accessible from the exterior of said mounting housing, said electrical terminal means extends from said electrical conductor means so as to be disposed in axially overlapping and radially outwardly spaced relationship to said enclosure, said mounting housing comprises a radially disposed wall portion which comprises aperture means through which said electrical conductor means passes to said electrical terminal means, and closure means on said electrical conductor means closing said aperture means.

5. In an inertia switch assembly of the type comprising an inertia switch assembly element disposed within a mounting housing, said inertia switch assembly element comprising an enclosure containing both an inertial mass that moves within said enclosure in response to the inertia switch assembly being subjected to certain velocity change and electrical contacts that are operated by said inertial mass to give a switch signal in response to motion of said inertial mass within said enclosure caused by said certain velocity change, said inertia switch assembly element being of the type comprising a magnetic circuit, including a magnet, that magnetically restrains said inertial mass, the improvement wherein said enclosure is non-magnetic, a magnetically conductive element that forms a part of said magnetic circuit at least partially envelopes said body, said magnetically conductive element comprises an axially slotted tube having an end wall, and said magnet is axially disposed between said end wall and said body.

6. In an inertia switch assembly of the type in which an inertia switch assembly element is disposed within a mounting housing, said inertia switch assembly element comprising an enclosure containing both an inertial mass that moves within said enclosure in response to the inertia switch assembly being subjected to certain velocity change and electrical contacts that are operated by said inertial mass to give a switch signal in response to motion of said inertial mass within said enclosure, the improvement which comprises an electrical conductor means via which said electrical contacts are placed in conducting relationship with an electrical terminal means which is accessible from the exterior of said mounting housing, and said mounting housing comprising an integral triangular shaped base via which said mounting housing can be mounted on a wall, said base comprising a metal sleeved aperture at each apex of the base through which a fastener can be passed for mounting said mounting housing on a wall.

7. In an inertia switch assembly of the type in which an inertia switch assembly element is disposed within a mounting housing, said inertia switch assembly element comprising an enclosure containing both an inertial mass that moves within said enclosure in response to the inertia switch assembly being subjected to certain velocity change and electrical contacts that are operated by said inertial mass to give a switch signal in response to motion of said inertial mass within said enclosure, the improvement which comprises an electrical conductor means via which said electrical contacts are placed in conducting relationship with an electrical terminal means which is accessible from the exterior of said mounting housing, and said mounting housing comprising an integral shroud disposed around and in cooperative relationship with said electrical terminal means so as to form a connector plug structure which can be connected with a mating connector plug of a wiring harness to connect the inertia switch assembly element with an associated electrical circuit.

* * * * *